US006024059A

United States Patent [19]

Kamimaru et al.

[11] Patent Number: 6,024,059

[45] Date of Patent: Feb. 15, 2000

[54] APPARATUS AND METHOD OF CONTROLLING ELECTROMAGNETIC VALVE

[75] Inventors: Shinji Kamimaru; Mitsunori Ishii, both of Mitaka, Japan

[73] Assignee: Fuji Jukogyo Kabushiki Kaisha, Tokyo, Japan

[21] Appl. No.: 09/178,550

[22] Filed: Oct. 26, 1998

[30] Foreign Application Priority Data

Nov. 12, 1997 [JP] Japan ..... 9-310804

[51] Int. Cl.[7] ..... F01L 9/04

[52] U.S. Cl. ..... 123/90.11; 251/129.01; 251/129.15; 335/268; 361/167

[58] Field of Search ..... 123/90.11; 251/129.01, 251/129.05, 129.1, 129.15, 129.16; 335/265, 266, 268, 271, 277; 361/160, 166, 167

[56] References Cited

U.S. PATENT DOCUMENTS

| | | | |
|---|---|---|---|
| 5,201,296 | 4/1993 | Wunning et al. | 123/479 |
| 5,671,705 | 9/1997 | Matsumoto et al. | 123/90.11 |
| 5,775,276 | 7/1998 | Yanai et al. | 123/90.11 |
| 5,782,211 | 7/1998 | Kamimaru | 123/90.11 |

FOREIGN PATENT DOCUMENTS 0 662 697 7/1995 European Pat. Off. .

0 867 602 A1 9/1998 European Pat. Off. .

*Primary Examiner*—Weilun Lo

*Attorney, Agent, or Firm*—Smith, Gambrell & Russell, LLP

[57] ABSTRACT

An electromagnetic valve has a first and a second electromagnetic coil and an armature. The first electromagnetic coil generates a magnetic filed to cause the armature to move a valve for closing. The second electromagnetic coil generates a magnetic filed to cause the armature to move the valve for opening. The first electromagnetic coil is energized to generate the magnetic field. Measurement of time at a first moment is started before the valve is moved to a first position at which the first electromagnetic coil is temporarily de-energized and to output a first signal after a predetermined period of time has passed from the first moment. The temporarily de-energized first electromagnetic coil is energized in response to the first signal. The first electromagnetic coil is de-energized when the valve is fully closed. The second electromagnetic coil is energized to generate the magnetic field after the first electromagnetic coil is de-energized. Measurement of time at a second moment is started before the valve is moved to a second position at which the second electromagnetic coil is temporarily de-energized and to output a second signal after a predetermined period of time has passed from the second moment. The temporarily de-energized second electromagnetic coil energized in response to the second signal. The second electromagnetic coil is de-energized when the valve is fully opened. The first electromagnetic coil is energized after the second magnetic coil is de-energized.

13 Claims, 12 Drawing Sheets

APPARATUS AND METHOD OF CONTROLLING ELECTROMAGNETIC VALVE

BACKGROUND OF THE INVENTION

This invention relates to an apparatus and a method of controlling an electromagnetic valve that opens or closes an intake and an exhaust valve of an engine by using an electromagnetic coil. A valve activating system has been developed. The system electromagnetically activates an intake and an exhaust valve and electrically controls opening/closing timing for the intake and exhaust valves.

The valve activating system provides a wide range of valve opening/closing timing to achieve appropriate valve opening/closing control in accordance with various engine operating conditions. On the other hand, a noise is produced when an armature hits an electromagnetic coil in each valve mechanism when the valve is accelerated by an electromagnetic coil or a spring. This results in low durability of such valve.

Japanese Patent Laid-Open No. 1996(8)-135416 discloses a control system for decelerating an electromagnetic valve having two solenoids arranged as facing each other. The valve is decelerated so that one of the solenoids which is usually energized while the valve is opened, is temporarily energized while the valve is closed, and the other solenoid which is usually energized while the valve is closed, is temporarily energized while the valve is opened. This system however cannot control valve opening/closing speeds because the speeds are not detected.

The applicant of this invention has filed Japanese Patent Application No. 1996(8)-230094 which discloses a technique for easing a shock produced when a valve sits on a valve seat or when an armature hits a yoke in a valve mechanism by lowering a speed for valve full closing or opening. The deceleration is carried out by temporarily de-energizing an electromagnetic coil for valve opening or closing when the valve reaches a predetermined position for opening or closing, and energizing again the electromagnetic coil when the valve reaches another predetermined position just before valve full closing or opening.

More in detail, as shown in FIG. 1, the Japanese Patent Application No. 1996(8)-230094 teaches that the electromagnetic coil is de-energized when an output of a lift sensor for detecting a position to where the valve is lifted reaches a trigger level VR2, and the electromagnetic coil is energized again when the sensor output reaches another trigger level VR3.

The valve speed after the electromagnetic coil is energized is not necessarily constant, or it sometimes varies in one valve operation cycle as represented by curves "a" and "b" in FIG. 1. The higher the valve speed, the shorter the period of time for the valve being lifted to reach the position corresponding to the trigger level VR3 from the position corresponding to the trigger level VR2. The valve speed is thus cannot be decelerated enough for easing the shock discussed above.

SUMMARY OF THE INVENTION

The present invention provides an apparatus and a method of controlling an electromagnetic valve that can attain a stable valve deceleration speed even if the valve speed varies while the valve is being decelerated by de-energizing the electromagnetic coil, to ease a shock of valve sitting caused when the valve is fully closed or which is produced when an armature hits a yoke when the valve is fully opened.

The present invention provides an apparatus for controlling an electromagnetic valve having at least an electromagnetic coil and an armature. The electromagnetic coil generates a magnetic filed to cause the armature to move a valve for opening or closing. The apparatus comprises a driver to energize the electromagnetic coil to generate the magnetic field, a timer to start at a moment before the valve is moved to a first position at which the electromagnetic coil is temporarily de-energized and to output a signal after a predetermined period of time has passed from the first moment, and a controller to control the driver to energize the temporarily de-energized electromagnetic coil in response to the signal.

Furthermore, the present invention provides a method of controlling an electromagnetic valve having at least an electromagnetic coil and an armature. The electromagnetic coil generating a magnetic filed to cause the armature to move a valve for opening or closing. The method comprising the steps of energizing the electromagnetic coil to generate the magnetic field, starting measurement of time at a moment before a second moment the valve is moved to a first position at which the electromagnetic coil is temporarily de-energized and to output a signal after a predetermined period of time has passed from the moment, and energizing the temporarily de-energized electromagnetic coil in response to the signal.

Furthermore, the present invention provides a method of controlling an electromagnetic valve having at least a first and a second electromagnetic coil and an armature. The first electromagnetic coil generates a first magnetic filed to cause the armature to move a valve for closing. The second electromagnetic coil generates a second magnetic filed to cause the armature to move the valve for opening. The method comprises the steps of energizing the first electromagnetic coil to generate the first magnetic field, starting first measurement of time at a first moment before the valve is moved to a first position at which the first electromagnetic coil is temporarily dc-energized and to output a first signal after a predetermined period of time has passed from the first moment, energizing the temporarily de-energized first electromagnetic coil in response to the first signal, de-energizing the first electromagnetic coil when the valve is fully closed, energizing the second electromagnetic coil to generate the second magnetic field after the first electromagnetic coil is de-energized, starting second measurement of time at a second moment before the valve is moved to a second position at which the second electromagnetic coil is temporarily de-energized and to output a second signal after a predetermined period of time has passed from the second moment, and energizing the temporarily de-energized second electromagnetic coil in response to the second signal.

DETAILED DESCRIPTION OF PREFERRED EMBODIMENTS

Figure 1:
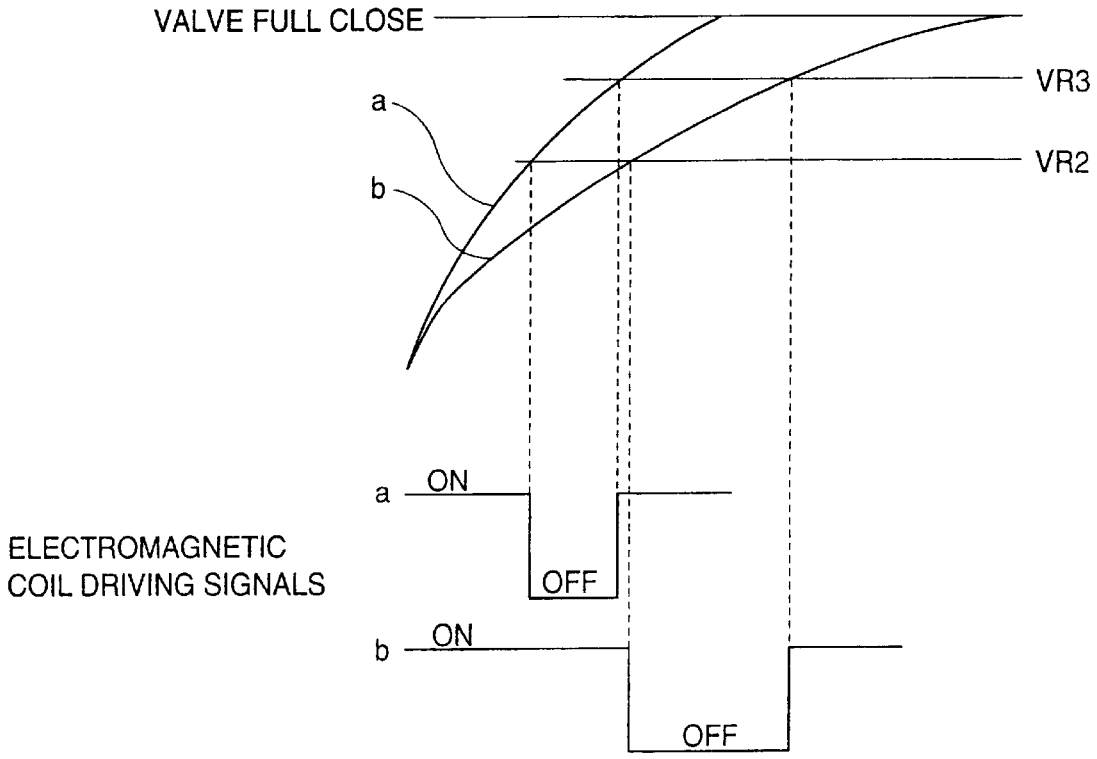
FIG.1 (PRIOR ART)
FIG. 1 is a graph explaining the relationship between lift sensor output and valve driving signals for a conventional apparatus for controlling an electromagnetic valve.
Figure 2:
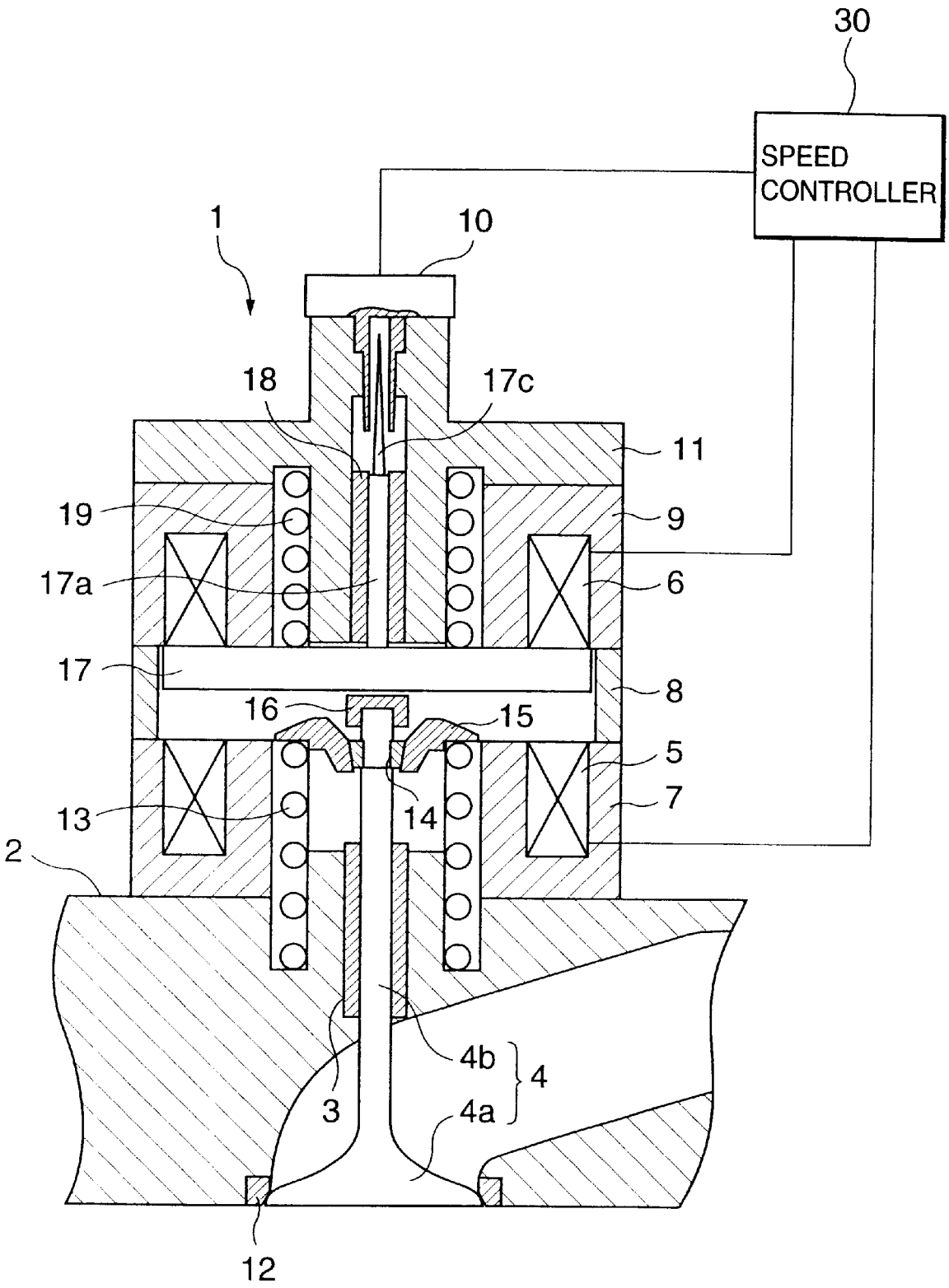
FIG. 2 is a sectional view of an electromagnetic valve according to the present invention.

Preferred embodiments according to the present invention will be described in detail with reference to the attached drawings. Shown in FIG. 2 is an electromagnetic valve 1 installed in an intake and an exhaust port of each cylinder of an engine. The electromagnetic valve 1 is a twin-coil type provided with an electromagnetic coil 5 for valve opening and another electromagnetic coil 6 for valve closing arranged as facing each other to open or close a valve 4 (an intake or an exhaust valve) slidably inserted into a valve stem guide 3 of a cylinder head 2.

The electromagnetic coil 5 is installed in a yoke 7 provided at the cylinder head 2 side and is connected to another yoke 9 that houses the electromagnetic coil 6 via a lift adjuster 8. The lift adjuster 8 adjusts an amount of lifting the valve 4 by canceling variation in size of components that constitute the electromagnetic valve 1. Formed on the yoke 9 is a guide for moving an armature 17 (which will be described later) in the axial direction. Furthermore, fixed to the yoke 9 is a casing 11 to which an eddy-current lift sensor 10 is attached.

Provided inside the electromagnetic coil 5 is a spring 13 for valve closing which presses a valve head 4*a* of the valve 4 against a valve sheet 12. The spring 13 is provided between a retainer 15 fixed to a portion of the valve stem 4*b* via a cotter pin 14, and a holder formed around a valve stem guide 3 at the cylinder head 2 side. A shim 16 for adjusting clearances (which will be described later) is attached to a tip of the valve stem 4*b*.

A flat armature 17 is provided in a space enclosed by the lift adjuster 8. The armature 17 opens or closes the valve 4 by a magnetic field produced when the electromagnetic coil 5 or 6 is energized.

The armature 17 is formed, at its center, with an armature stem 17*a* at the electromagnetic coil 5 side. The armature 17 and the armature stem 17*a* may be formed separately. The armature stem 17*a* is fixed so that it stands on the armature 17. The armature stem 17*a* is slidably inserted into an armature stem guide 18 which is provided around a cylinder portion of the casing 11. The cylinder portion protruds into the electromagnetic coil 6. A spring 19 for valve opening is provided between the armature 17 and a holding portion formed on the base of the cylinder portion of the casing 11. The spring 19 forces the valve head 4*a* to leave valve sheet 12.

While both the electromagnetic coils 5 and 6 are being de-energized, the armature 17 touches the shim 16 and stops at a position where the forces of the springs 13 and 19 balance with each other.

A needle-like target 17*c* is formed at a tip of the armature stem 17*a*. Movement of the target 17*c* is detected by the lift sensor 10. The movement of the target 17*c* in the axial direction detected by the lift sensor 10 corresponds how much the valve 4 is lifted (lifting amount). The lift sensor 10 outputs voltages linear to the lifting amount when an output voltage is set at zero at a position where the valve 4 is fully opened.

Figure 3:
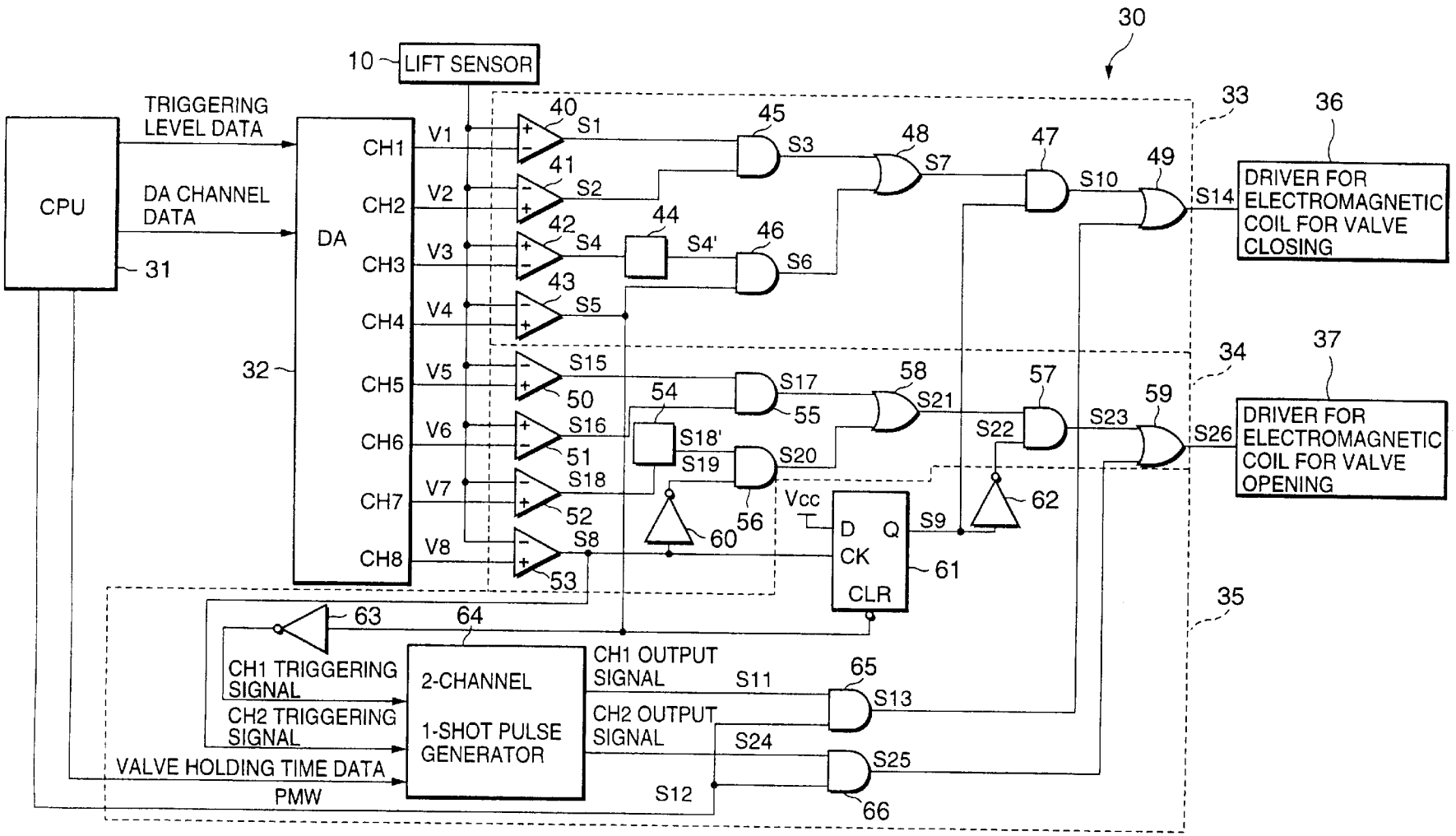
FIG. 3 is a circuit diagram of a speed controller as the first preferred embodiment according to the present invention.

The electromagnetic valve 1 is controlled by a speed controller 30 which is connected to the electromagnetic coils 5 and 6, and the lift sensor 10. The speed controller 30 (the first embodiment) is shown in FIG. 3. A microcomputer, or a central processing unit (CPU) 31 calculates opening/closing timing for the intake and exhaust valves for each cylinder based on various data, such as, engine speed, accelerator opening angle, clank angle pulse, coolant temperature, and so on. The CPU 31 alternatively energizes the electromagnetic coils 5 and 6 at the opening/closing timing via a driver 36 for driving the coil 6 for valve closing and another driver 37 for driving the coil 5 for valve opening, respectively, thus opening or closing the valve 4.

More in detail, the electromagnetic coil 6 for valve closing is de-energized and then the electromagnetic coil 5 for valve opening is energized at the calculated timing to open the valve 4. The armature 17 is moved to the electromagnetic coil 5 side from a position where the forces of the spring 13 for valve closing and the spring 19 for valve opening are balanced with each other. The movement of the armature 17 is made by attraction produced at the electromagnetic coil 5. The armature 17 is then attracted by the coil 5 and stopped where the valve 4 reaches the maximum lifting position (valve fullopen position) to complete the valve opening operation.

On the other hand, in order to close the valve 4, the electromagnetic coil 5 for valve opening is de-energized and then the electromagnetic coil 6 for valve closing is energized at the calculated timing. The armature 17 goes back to the electromagnetic coil 6 side due to a force to return to the position where the forces of the springs 13 and 19 are balanced with each other and attraction produced at the electromagnetic coil 6. The armature 17 is then attracted by the coil 6 and stopped so that it leaves the shim 16 attached to the tip of the valve stem 4*b* to adjust the clearance. The valve head 4*a* is then pressed against the valve seat 12 by the spring 13 for valve closing to sit there (valve full closing).

Figure 4:
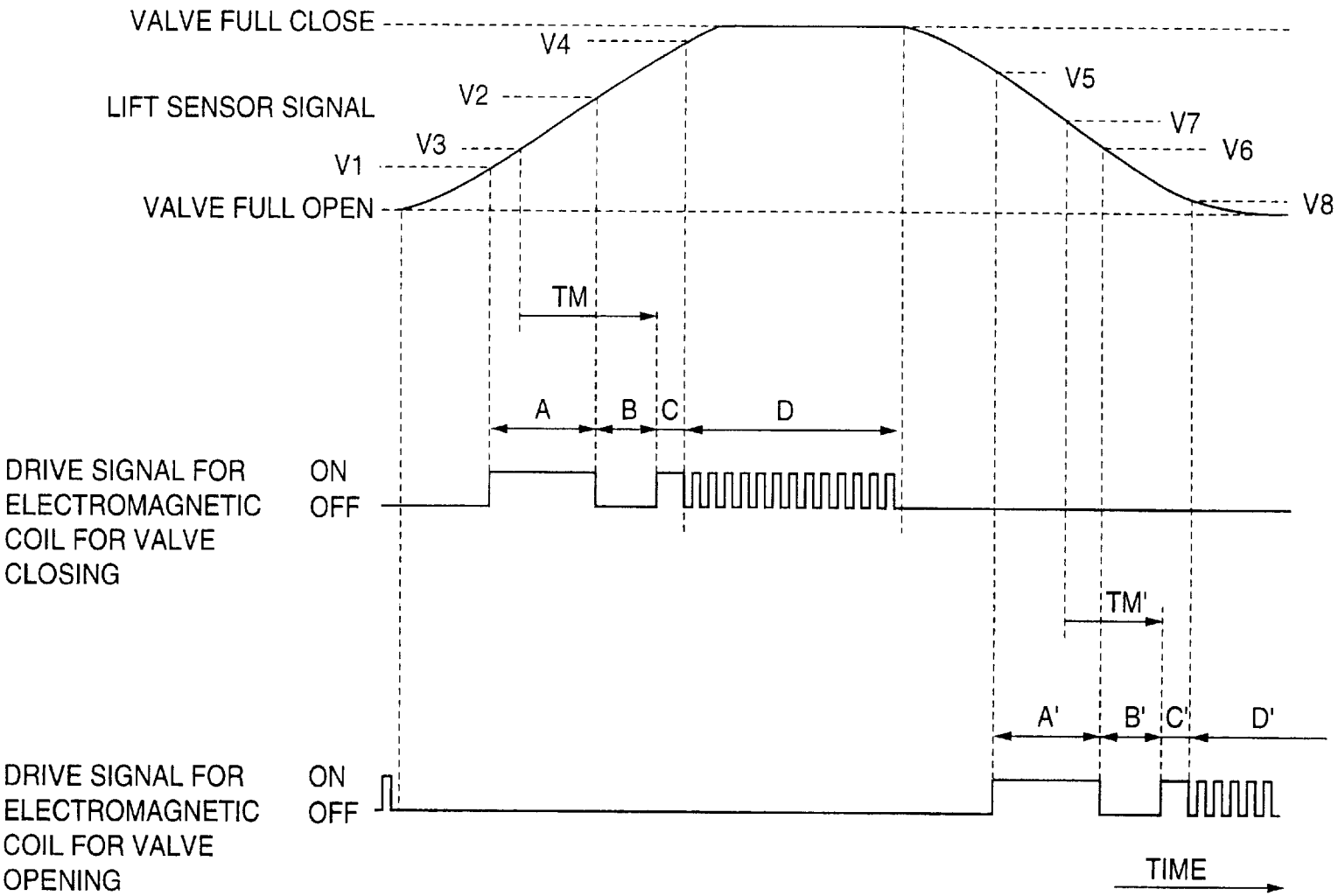
FIG. 4 illustrates waveforms of valve driving signals according to the present invention.

The waveform of driving signals for the electromagnetic valve 1 varies in accordance with timing, that is, the moment at which the valve 4 reaches to a predetermined position which is detected by the lift sensor 10 and another moment after a predetermined period of time has passed since the valve 4 reached the position. The waveforms of the driving signals vary during the four terms "A", "B", "C" and "D" for valve closing, and the other four terms "A'", "B'", "C'" and "D'" for valve opening as shown in FIG. 4 according to the present embodiment.

In detail, the armature 17 is accelerated during the term "A" or "A'" where a driving signal for the electromagnetic coil 6 for valve closing or the electromagnetic coil 5 for valve opening is on. The armature 17 is then decelerated during the next term "B" or "B'" where the driving signal for the electromagnetic coil 6 or 5 is temporarily off to ease a shock of valve sitting caused when the valve 1 is fully closed or shock of a collision of the armature 17 with the yoke 7 caused when the valve 1 is fully opened.

The driving signal for the coil 5 or the coil 6 is turned on again to adjust the speed of the armature 17 during the term "C'" or "C". The term "C" for the coil 6 is just before the valve full closing and after a predetermined period of time TM which has passed since the valve 4 was lifted to a predetermined position corresponding to a triggering level V3. The term "C'" for the coil 5 is just before the valve full opening and after another predetermined period of time TM' which has passed since the valve 4 was lifted to another predetermined position corresponding to a triggering level V7. The triggering levels V3 and V7 will be described later.

During the succeeding term "D'" or "D" just after the valve 4 is fully closed or opened, chopping is carried out by pulse width modulation (PWM) to control a coil current flowing through the coil 5 or 6, as a specific coil holding current.

The speed of the armature 17 depends how much it is accelerated during the term "A" or "A'". In general, all the driving signal on/off timing for the coil 5 or 6 during the terms "A'" to "D'" or "A" to "D" are determined as corresponding to predetermined positions to which the valve 4 is lifted. However, the higher the speed of the armature 17 during the term "A" or "A'", the shorter the term "B" or "B'" for decelerating the armature 17. This means that the valve 4 reaches the position for full closing or opening without enough time for armature deceleration. This results in that the shocks generated when the valve 1 is fully closed or opened as discussed for the term "B" or "B'" can not be eased.

The speed controller 30 according to the present invention makes longer the term "B" or "B'" relative to the other terms when the speed of the armature 17 is high to have enough armature deceleration time. On the other hand, when the speed of the armature 17 is low, the controller 30 makes shorter the term "B" or "B'" relative to the other terms to avoid unnecessary longer armature deceleration time. Stable deceleration of the armature 17 is thus achieved even if the speed of the armature 17 varies, to ease the shocks generated when the valve 1 is fully closed or opened as discussed above.

The speed controller 30 is described in detail. As shown in FIG. 3, the speed controller 30 is provided with the CPU 31, a digital-to-analog (DA) converter 32, a controller 33 for the electromagnetic coil 6 for valve closing, a controller 34 for the electromagnetic coil 5 for valve opening and a controller 35 for the coil holding current.

The CPU 31 calculates opening/closing timing for the intake and exhaust valves for each cylinder based on various data, such as, engine speed, accelerator opening angle, clank angle pulse, coolant temperature, and so on. Then, the CPU 31 outputs triggering level data to the DA converter 32 to decide the terms "A" to "D" or "A'" to "D'" shown in FIG. 4. Furthermore, the CPU 31 outputs valve holding time data and a PWM signal to the controller 35 for the coil holding current. The valve holding time data is used to decide a period of time for valve full opening or closing that is the term "D'" or "D" in FIG. 4 for the coil current control.

The circuit diagram shown in FIG. 3 is for controlling one electromagnetic valve 1. However, a plurality of circuits will be provided when this invention is applied to an engine, and the number of the DA converter 32, the controllers 33, 34 and 35 corresponds to the number of intake and exhaust valves of the engine to which this invention is applied.

The DA converter 32 is provided with ports of ch1 to ch8, totally eight channels. The DA converter 32 converts the triggering level data supplied from the CPU 31 into analog signals and outputs analog voltages at channels designated by DA channel data also supplied from the CPU 31. The channels ch1 to ch4 are used for outputting analog voltages (triggering levels) V1 to V4, respectively, to the controller 33 for the electromagnetic coil 6 for valve closing. The channels ch5 to ch8 are used for outputting analog voltages V5 to V8 (triggering levels), respectively, to the controller 34 for the electromagnetic coil 5 for valve opening.

In detail, the channels ch1 and ch5 correspond to the triggering levels V1 and V5, respectively. As shown in FIG. 4, the levels V1 and V5 decide the timing for the drive signals for the coils 6 and 5, respectively, to be on, or rise to start the terms "A" and "A'", respectively. The channels ch2 and ch6 correspond to the triggering levels V2 and V6, respectively. The levels V2 and V6 decide the timing for those drive signals to be off, or fall to halt the terms "A" and "A'", respectively. The channels ch3 and ch7 correspond to the triggering levels V3 and V7, respectively. The levels V3 and V7 decide the timing for those drive signals to be on, or rise again to halt the terms "B" and "B'", respectively, or start the terms "C" and "C'", respectively. Furthermore, the channels ch4 and ch8 correspond to the triggering levels V4 and V8, respectively. The levels V4 and V8 decide the timing to start the terms "D" and "D'", respectively.

The controller 33 for the electromagnetic coil 6 for valve closing is provided with comparators 40, 41, 42 and 43, a timer 44, AND gates 45, 46 and 47, and OR gates 48 and 49.

An output voltage of the lift sensor 10 is supplied to the comparator 40 at its non-inverting input terminal, the comparator 41 at its inverting input terminal, the comparator 42 at its non-inverting input terminal and the comparator 43 at its inverting input terminal. Also supplied to these comparators are the analog voltages (triggering levels) V1 to V4 from the DA converter 32 at the channels ch1 to ch4, respectively. In detail, the voltage V1 is supplied to the comparator 40 at its inverting input terminal, the voltage V2 to the comparator 41 at its non-inverting input terminal, the voltage V3 to the comparator 42 at its inverting input terminal, and the voltage V4 to the comparator 43 at its non-inverting input terminal.

Output signals S1 and S2 of the comparators 40 and 41, respectively, are supplied to the AND gate 45. An output signal S4 of the comparator 42 is supplied to the timer 44. An output signal S4' of the timer 44 and an output signal S5 of the comparator 43 are supplied to the AND gate 46. Output signals S3 and S6 of the AND gates 45 and 46, respectively, are supplied to the OR gate 48. An output signal S7 of the OR gate 48 and an output signal S9 of the controller 35 for the coil holding current arc supplied to the AND gate 47. An output signal S10 of the AND gate 47 and an output signal S13 of the controller 35 are supplied to the OR gate 49. An output signal S14 of the OR gate 49 is then supplied to the driver 36, put into a power device, for driving the coil 6 for valve closing.

The controller 34 for the electromagnetic coil 5 for valve opening is provided with comparators 50, 51, 52 and 53, a timer 54, AND gates 55, 56 and 57, OR gates 58 and 59, and an inverter 60.

The output voltage of the lift sensor 10 is further supplied to the comparator 50 at its inverting input terminal, the comparator 51 at its non-inverting input terminal, the comparator 52 at its inverting input terminal and the comparator 53 at its non-inverting input terminal. Also supplied to these comparators are the analog voltages (triggering levels) V5 to V8 from the DA converter 32 at the channels ch5 to ch8, respectively. In detail, the voltage V5 is supplied to the comparator 50 at its non-inverting input terminal, the voltage V6 to the comparator 51 at its inverting input terminal, the voltage V7 to the comparator 52 at its non-inverting input terminal, and the voltage V8 to the comparator 53 at its non-inverting input terminal.

Output signals S15 and S16 of the comparators 50 and 51, respectively, are supplied to the AND gate 55. An output signal S18 of the comparator 52 is supplied to the timer 54. An output signal S8 of the comparator 53 is supplied to the inverter 60. An output signal S18' of the timer 54 and an output signal S19 of the inverter 60 arc supplied to the AND gate 56. Output signals S17 and S20 of the AND gates 55 and 56, respectively, are supplied to the OR gate 58. An output signal S21 of the OR gate 58 and an output signal S22 of the controller 35 for the coil holding current are supplied to the AND gate 57. An output signal S23 of the AND gate 57 and an output signal S25 of the controller 35 are supplied to the OR gate 59. An output signal S26 of the OR gate 59 is then supplied to the driver 37, put into a power device, for driving the coil 5 for valve opening.

The controller 35 for the coil holding current is provided with a D flip-flop 61, inverters 62 and 63, two-channel one-shot pulse generator 64, and AND gates 65 and 66.

The output of the D flip-flop 61 and its inverted signal are used to switch the logic outputs between a logic circuit composed of the AND gates 45 and 46 and the OR gate 48, and another logic circuit composed of the AND gates 55 and 56 and the OR gate 58. The controller 35 accepts the PWM signal supplied from the CPU 31 and outputs the signal at one of the two-channel side decided by an channel output of the two-channel one-shot pulse generator 64 for a period of time designated by the valve holding time data also supplied from the CPU 31.

In detail, the D flip-flop 61 operates as follows: When a CLR terminal voltage level is high, a signal at the D terminal is transferred to the Q terminal at the moment a signal supplied to the CK terminal rises. On the other hand, a Q terminal voltage level turns into low when the CLR terminal voltage level is low. The D terminal is always pulled up to a supply voltage level Vcc. The output signal S8 of the comparator 53 of the controller 34 for the electromagnetic coil 5 for valve opening is supplied to the CK terminal. The output signal S5 of the comparator 43 of the controller 33 for the electromagnetic coil 6 for valve closing is supplied to the CLR terminal. The output signal S9 at the Q terminal is supplied to the AND gate 47 of the controller 33. The signal S9 is further inverted by the inverter 62 and its output signal S22 is supplied to the AND gate 57 of the controller 34.

The two-channel one-shot pulse generator 64 outputs a high level signal at the moment a channel triggering signal rises and continuously outputs the signal for the period of time designated by the pulse holding time data supplied from the CPU 31 at channel designated by the channel triggering signal. Employed as the triggering signal for the channel ch 1 is the signal to which the output signal S5 of the comparator 43 of the controller 33 for the electromagnetic coil 6 for valve closing is inverted by the inverter 63. Employed as the triggering signal for the channel ch2 is the signal to which the output signal S8 of the comparator 53 of the controller 34 for the electromagnetic coil 5 for valve opening.

A ch1 output signal S11 of the two-channel one-shot pulse generator 64 and the PMW signal S12 from the CPU 31 are supplied to an AND gate 65. An output signal S13 of the AND gate 65 is then supplied to the OR gate 49 of the controller 33 for the electromagnetic coil 6 for valve closing. On the hand, a ch2 output signal S24 of the one-shot pulse generator 64 and the PMW signal S12 are supplied to an AND gate 66. An output signal S25 of the AND gate 66 is then supplied to the OR gate 59 of the controller 34 for the electromagnetic coil 5 for valve opening.

Figure 5:
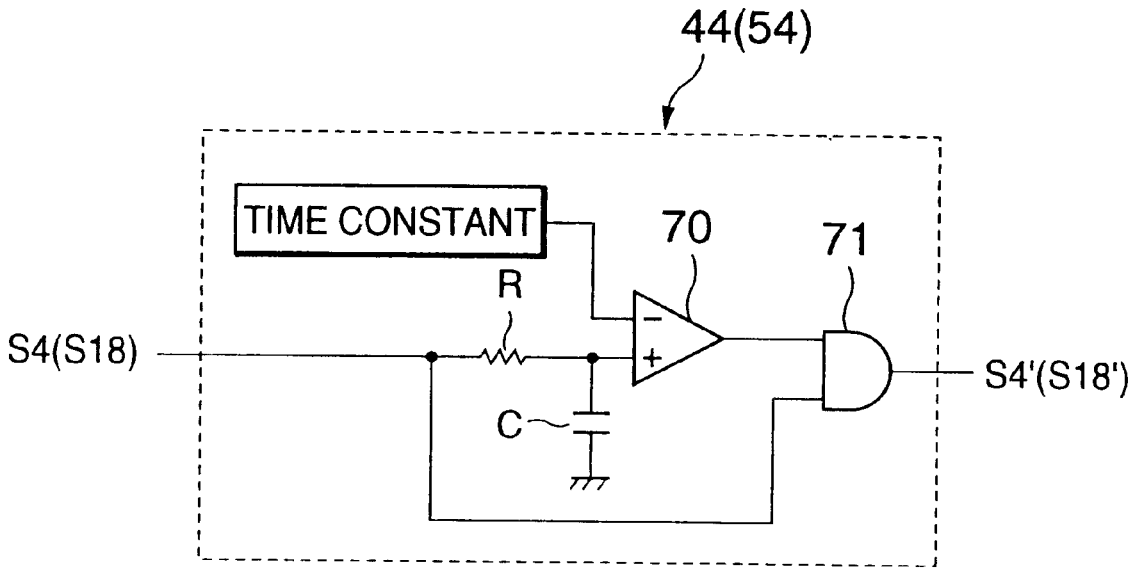
FIG. 5 is a circuit diagram of timers used for the speed controller shown in FIG. 3.

Next, shown in FIG. 5 is the circuit diagram of the timers 44 and 54 of the controllers 33 and 34, respectively. Each timer is an analog timer provided with an integrator composed of a resistor R and a capacitor C, a comparator 70 and an AND gate 71.

Description is made for the timer 44 of the controller 33 for the electromagnetic coil 6 for valve closing.

Supplied to the integrator is the output signal S4 of the comparator 42. The output signal of the integrator is supplied to the comparator 70 at its non-inverting input terminal and is compared with a reference voltage corresponding to a set time constant. The signal S4 and the output of the comparator 70 are supplied to the AND gate 71, and the signal S4 is output therefrom as the timer output signal S4'.

The same as the timer 44 described above, the timer 54 of the controller 34 for the electromagnetic coil 5 for valve opening operates as follows:

The output signal S18 of the comparator 52 is supplied to the integrator. The output signal of the integrator is supplied to the comparator 70 at its non-inverting input terminal. The output signal is compared with a reference voltage that corresponds to a set time constant. The signal S18 and the output of the comparator 70 are supplied to the AND gate 71, and the signal S18 is output therefrom as the timer output signal S18'.

The AND gate 71 is provided to prevent the signal S4 or S18 from being output as a hazardous signal via the integrator to the later stage at the moment the signal S4 or S18 turns into a high level.

The analog voltages (triggering levels) V1 to V4 supplied to the comparators 40 to 43, respectively, from the DA converter 32 shown in FIG. 3 are determined as V1<V3<V2<V4 corresponding to the output level of the lift sensor 10, that is, in the range of zero to the maximum level that corresponds to a position of the valve 4 lifted for valve full opening to valve full closing, respectively.

The outputs of the comaprators 40 to 43 are inverted in response to variation in the output of the lift sensor 10 due to the movement of the valve 4 in the direction of closing. Supplied to the AND gate 47 are, as already described, the logical output (S7) of the logic circuit composed of the AND gates 45 and 46 and the OR gate 48, and the signal S9 (output of D flip-flop at Q terminal) from the controller 35 for coil holding current. The output of the AND gate 47 is then supplied to the OR gate 49.

The analog voltages (triggering levels) V5 to V8 supplied to the comparators 50 to 53, respectively, from the DA converter 32 are determined as V5<V7<V6<V8 corresponding to the output level of the lift sensor 10, that is, in the range of the maximum level to zero that corresponds to a position of the valve 4 lifted for valve full closing to valve full opening, respectively.

The outputs of the comparators 50 to 53 are inverted in response to variation in the output of the lift sensor 10 due to the movement of the valve 4 in the direction of opening. Supplied to the AND gate 57 are, as already described, the logical output (S21) of the logic circuit composed of the AND gates 55 and 56 and the OR gate 58, and the signal S22 (the inverted signal of the signal S9 of output of D flip-flop at Q terminal) from the controller 35 for coil holding current. The output of the AND gate 57 is then supplied to the OR gate 59.

The output (S9) of the D flip-flop 61 at the Q terminal varies in accordance with the signal S5 supplied to the CLR terminal from the comparator 43 of the controller 33 for the electromagnetic coil 6 for valve closing and also the signal S8 supplied to the CK terminal from the comparator 53 of the controller 34 for the electromagnetic coil 5 for valve opening.

Figure 6:
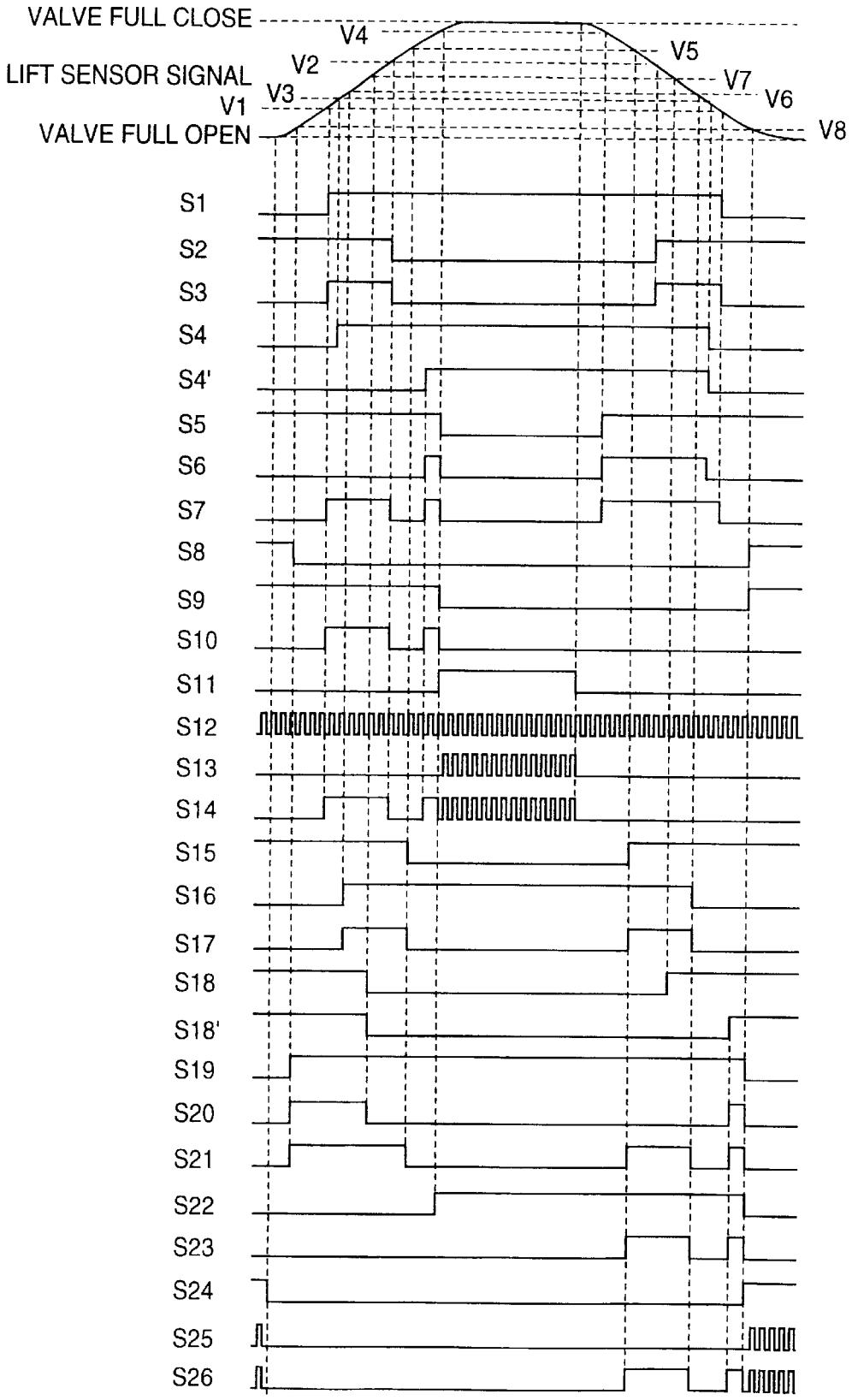
FIG. 6 is a timing chart explaining the timing for various signals shown in FIG. 3.

As shown in FIG. 6, the output signal S5 of the comparator 43 is low during a period for the output of the lift sensor 10 supplied to the comparator 43 being larger than the triggering level V4 also supplied thereto. This comparison result is obtained only when the valve 4 comes close or reach the valve full closing position.

On the other hand, the output signal S8 of the comparator 53 is high during a period for the output of the lift sensor 10 supplied to the comparator 53 being smaller than the triggering level V8 also supplied thereto. This comparison result is obtained only when the valve 4 comes close or reach the valve full opening position.

This results in that the output signal S9 of the D flip-flop 61 at the Q terminal is low during the periods from the moment just before valve full closing, through the valve full closing period and the gradual valve opening period, to the moment just before valve full opening.

Accordingly, during the valve closing operation while the signal S9 is being high, the logical output (S7) of the logic circuit composed of the AND gates 45 and 46 and the OR gate 48 is allowed to be output from the AND gate 47 as the signal S10; on the other hand, the logical output (S21) of the logic circuit composed of the AND gates 55 and 56 and the OR gate 58 is inhibited to be output from the AND gate 57 except the valve full opening period.

On the contrary, during the valve opening operation while the signal S9 is being low, the logical output (S7) of the logic circuit composed of the AND gates 45 and 46 and the OR gate 48 is inhibited to be output from the AND gate 47; on the other hand, the logical output (S21) of the logic circuit composed of the AND gates 55 and 56 and the OR gate 58 is allowed to be output from the AND gate 57 as the signal S23 except the valve full closing period.

Operations during the valve full opening period while the signal S9 is being high and also during the valve fill closing period while the signal S9 is being low will be discussed later.

Next, description is made mainly for the controller 33 for the electromagnetic coil 6 for valve closing. This is because the controller 33 and the controller 34 for the electromagnetic coil 5 for valve opening operate almost the same way.

Suppose that the electromagnetic valve 1 is fully opened, and the period of time designated by the valve holding time data from the CPU 31 has passed to terminate the term for controlling the coil holding current by means of the PWM signal.

The electromagnetic coil 5 for valve opening is then de-energized to move the valve 4 from the valve full opening position to valve closing positions. In the initial state for this valve movement, where the output of the lift sensor 10 is smaller than the trigger level V1, the outputs signals S1 (comparator 40), S2 (comparator 41), S4 (comparator 42) and S5 (comparator 43) are at low, high, low and high levels, respectively.

Accordingly, the output signal S3 of the AND gate 45 to which the signals S1 and S2 are supplied, and also the output signal S6 of the AND gate 46 to which the signals S4' (from timer 44) and S5 are supplied, are both at low levels. The outputs signal S7 of the OR gate 48 to which the signals S3 and S6 are supplied is at a low level. The output signal S10 of the AND gate 47 to which the signal S7 is supplied is also at a low level. The signal S10 at the low level and the output signal S13 of the AND gate 65 of the controller 35 for coil holding current are ORed by the OR gate 49, thus outputting the signal S14 to the driver 36 for driving the coil 6 for valve closing. The signal S13 is the output of the AND gate 65 to which supplied are the ch1 output signal S11 of the one-shot pulse generator 64 and the PWM signal from the CPU 31. The signal S13 is being at a low level until just before the valve full closing because the ch1 output signal S11 is turned into a high level when the output of the lift sensor 10 exceeds the triggering level V4 just before the valve full closing and remains at the high level for the period of time designated by the valve holding time data from the CPU 31.

The signal S14 supplied from the OR gate 49 to the driver 46 for the electromagnetic coil 6 for valve closing is at a low level when the output of the lift sensor 10 is smaller than the triggering level V1 in the initial state of the valve closing operation. The coil 6 is thus not energized, that is, both the coils 5 and 6 are de-energized, and the valve 4 is moved from the position for the valve full opening to another position (in the direction of valve closing) at which the forces of the coils 13 and 19 for valve full closing and opening, respectively, are balanced with each other.

This movement of the valve 4 in the direction of valve closing makes the output of the lift sensor 10 being larger than the triggering level V1 both supplied to the comparator 40. The output signal S1 of the comparator 40 is thus turned into the high level from a low level. At this moment, the output of the lift sensor 10 is smaller than the triggering level V2 both supplied to the comparator 41. The output signal S2 of the comparator 41 is at the high level. The output signal S3 of the AND gate 45 to which the signals S1 and S2 at the high levels, is also at a high level. A high level signal S7 is then output from the OR gate 48 and supplied to the AND gate 47. Also supplied to the AND gate 47 is the signal S9 from the D flip-flop 61 at the Q terminal.

The signal S9, as already described, remains at the high level just before the valve full closing where the output of the lift sensor 10 exceeds the triggering level V4 from the comparator 43. The output signal S10 of the AND gate 47 at a high level is supplied to the OR gate 49 which then outputs a high level signal S14 to the driver 36 for the electromagnetic coil 6 for valve closing.

The coil 6 for valve closing is then energized (the term "A" of FIG. 4). The armature 17 is accelerated and moved in the direction of valve closing by attraction of the coil 6. This movement of the armature 17 in the direction of valve closing makes the output of the lift sensor 10 being larger than the triggering level V3 both supplied to the comparator 42. The output signal S4 of the comparator 42 is turned into a high level from the low level to activate the timer 44. The capacitor C of the timer 44 is charged with the high level signal S4 via the resistor R as shown in FIG. 5. The timer 44 starts as an analog timer. The output of the comparator 70 remains at a low level until the voltage supplied thereto at the non-inverting input terminal exceeds the reference voltage also supplied thereto at the inverting input terminal. The outputs signal S4' of the AND gate 71, or the timer output supplied to the OR gate 48 via the AND gate 46 as the signal S6 remains at the low level.

The output of the controller 33 for the electromagnetic coil 6 for valve closing still remains at the high level at the moment the output of the lift sensor 10 exceeds the triggering level V3 and the timer 44 starts. The armature 17 is farther moved in the direction of valve closing. The output signal S2 of the comparator 41 is then turned into a low level when the output of the lift sensor 10 exceeds the triggering level V2.

The low level signal S2 forces the output signal S3 of the AND gate 45 to be turned into a low level. The low level signal S4' also forces the output signal S6 of the AND gate 46 to be turned into the low level. The OR gate 48 thus outputs a low level signal S7 to the AND gate 47. The low level signal S7 is supplied to the OR gate 49 together with the low level signal S13 from the AND gate 65 of the controller 35 for coil holding current. The output signal S14 of the OR gate 49 is turned into the low level to de-energize the electromagnetic coil 6 for valve closing. The armature 17 is thus decelerated during the term "B" as shown in FIG. 4.

The coil 6 that is de-energized for armature deceleration is energized again when the timer 44 stops. After the timer 44 Starts, the capacitor C of FIG. 5 is gradually charged enough for the voltage at the non-inverting input terminal of the comparator 70 exceeding the reference voltage corresponding to the set time constant. When a period of time TM (FIG. 4) set for the timer 44 has passed, the output of the comparator 70 is turned into a high level to turn the output signal S4' of the AND gate 71 into a high level.

The time constant for the timer 44 is set in expectation of valve speed variation so that the timer 44 stops at a position to which the valve 4 is lifted just before it is lifted to the position at which the valve 1 is fully closed (or fully opened for the timer 54) even if the valve 4 is lifted at the maximum speed.

The high level timer output signal S4' forces the output signal S6 of the AND gate 46 to turn into a high level. The high level signal S6 is supplied to the OR gate 48. The output signal S7 is turned into a high level even though the other input signal S3 to the OR gate 48 is at the low level. The high level signal S7 is output from the OR gate 48 and supplied to the OR gate 49 via the AND gate 47. The high level signal S14 is output again from the OR gate 49 to the driver 36 for the electromagnetic coil 6 for valve closing to adjust the speed of the armature 17 (term "C" in FIG. 4).

Figure 7:
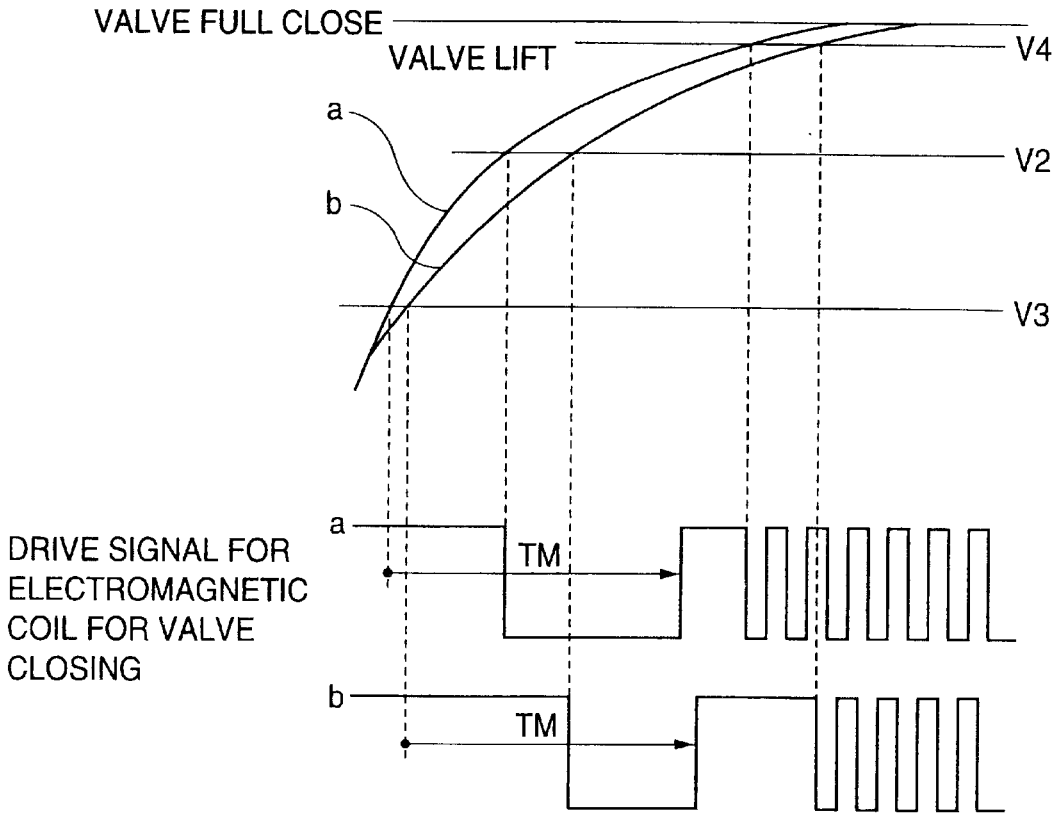
FIG. 7 is a graph explaining the relationship between lift sensor output and valve driving signals for the speed controller shown in FIG. 3.

As shown in FIG. 7, for a high valve speed as represented by a curve "a", the electromagnetic coil 6 for valve closing is de-energized sooner than for a low valve speed as represented by a curve "b". At a position where the valve 4 is lifted and corresponding to the triggering level V3, a difference in valve speed on the curves "a" and "b" is still small, so that a difference in timing for energizing the coil 6 again after the timer 44 stops is also small on the curves. the period of time for the coil 6 being de-energized for deceleration of the armature 17 is relatively long for high valve speeds while short for low valve speeds. The same is true for the timing for temporarily de-energizing the electromagnetic coil 5 for valve opening.

Accordingly, a stable deceleration time for the armature 17 is achieved even though a speed of the armature varies. Furthermore, a burden for the CPU 31 can be lightened by a high speed operation with the analog timer 44, and a shock of valve sitting caused when the valve 1 is fully closed or which is produced when the armature 17 hits the yoke 7 when the valve 1 is fully opened.

When the valve head 4*a* is pressed against the valve sheet 12 by the spring 13 for valve closing and sits there or comes close to there, the output of the lift sensor 10 exceeds the triggering level V4. The output signal S5 of the comparator 43 is then turned into a low from the high level to cause the output signal S6 of the AND gate 46 to turn into a low level. The output signal S7 of the OR gate 48 is also turned into a low level to cause the output signal S10 of the AND gate 47 to turn into the low level. The low level signal S10 is then supplied to the OR gate 49.

The low level signal S5 is also supplied to the D flip-flop 61 at the CLR terminal (of the driver 35 for coil holding current) and further supplied to the one-shot pulse generator 64 as the high level ch1 triggering signal via the inverter 63.

The output signal S9 at the Q terminal of the D flip-flop 61 is turned into the low level. The low level signal S9 is supplied to the AND gate 47 of the controller 33 for the electromagnetic coil 6 for valve closing to inhibit the logical output (S7) of the logic circuit composed of the AND gates 45 and 46, and the OR gate 48 of the controller 33 to be output from the AND gate 47 as the signal S10. On the other hand, the low level signal S9 is inverted by the inverter 62, and then the high level signal S9, that is, the high level signal S22 is supplied to the AND gate 57 of the controller 34 for the electromagnetic coil 5 for valve opening. The high level signal S22 allows the logical output (S21) of the logic circuit composed of the AND gates 55 and 56, and the OR gate 58 of the controller 34 to be output from the AND gate 57 as the signal S23 for the next valve opening operation.

The one-shot pulse generator 64 outputs a one-shot pulse of a width corresponding to the valve holding data supplied from CPU 31 at the moment the ch1 triggering signal rises. The output one-shot pulse is supplied to the AND gate 65 as the ch1 output signal. The ch1 output signal allows the PWN signal from the CPU 31 to be supplied via the AND gate 65 to the OR gate 49 of the of the controller 33 for the electromagnetic coil 6 for valve closing. The PWN signal only is then supplied from the OR gate 49 to the controller 36 for the electromagnetic coil 6 for valve closing to keep a coil current flowing through the coil 6 as a specific holding current (term "D" of FIG. 4).

While the controller 33 for the electromagnetic coil 6 for valve closing is working as described above, the controller 34 for the electromagnetic coil 5 for valve opening works as follows:

During the term in which the output of the lift sensor 10 is larger than the triggering level V5, the output signals S15, S18 and S8 of the comparators 50, 52 and 53, respectively, are all at a low level while the output signal S16 of the comparator 51 is at a high level. The high level output signal S8 of the comparator 53 is inverted by the inverter 60, and a low level signal S19 is supplied to the AND gate 56. The logical output (S21) of the logic circuit composed of the AND gates 55 and 56, and the OR gate 58 is at a low level. This logical state is the same as that for the controller 33 for the electromagnetic coil 6 for valve closing at the initial state of valve closing.

The AND gate 57 to which the low level signal S21 is supplied from the OR gate 58 thus outputs a low level signal S23. Since the ch2 output signal from the one-shot pulse generator 64 is at a low level, the AND gate 66 output a low level signal S25. The OR gate 59 to which the low level signals S23 and S25 are supplied outputs a low level signal S26. The electromagnetic coil 5 for valve opening thus remains de-energized by the driver 37.

When a period of time designated by the valve holding time data output by the CPU 31 has passed, the ch1 output signal from the one-shot pulse generator 64 turns into a low level. The low level ch1 output signal causes the output signal S25 of the AND gate 65 to turn into a low level. The output signal S14 of the OR gate 49 of the controller 33 for the electromagnetic coil 6 for valve closing is then turned into the low level. The coil current control for the coil 6 at the valve fully closed position thus terminates and is switched to the valve opening operation.

The opening operation starts when the valve 4 is moved from the valve fully closed position in the valve opening direction in which the forces of the springs 13 and 19 for valve closing and opening, respectively, balance with each other.

The logical output (S21) of the logic circuit composed of the AND gates 55 and 56, and the OR gate 58 varies in accordance with the results of comparison between the output of the lift sensor 10 and the triggering levels V5, V7, V6 and V8 (V5>V7>V6>V8). The OR gate 58 generates driving pulses having the same waveforms (FIG. 4) as those for the valve closing as already described.

Next, a speed controller 30A as the second preferred embodiment according to the present invention will be described with reference to FIG. 8. Elements in this embodiment that are the same as or analogous to elements in the first embodiment are referenced by the same reference numerals and will not be explained in detail.

The speed controller 30 shown in FIG. 3 is provided with the analog timers 44 and 45. On the other hand, the speed controller 30A shown in FIG. 8 is provided with a digital timer 3 la involved in a CPU 31A using internal clock signals.

Figure 8:
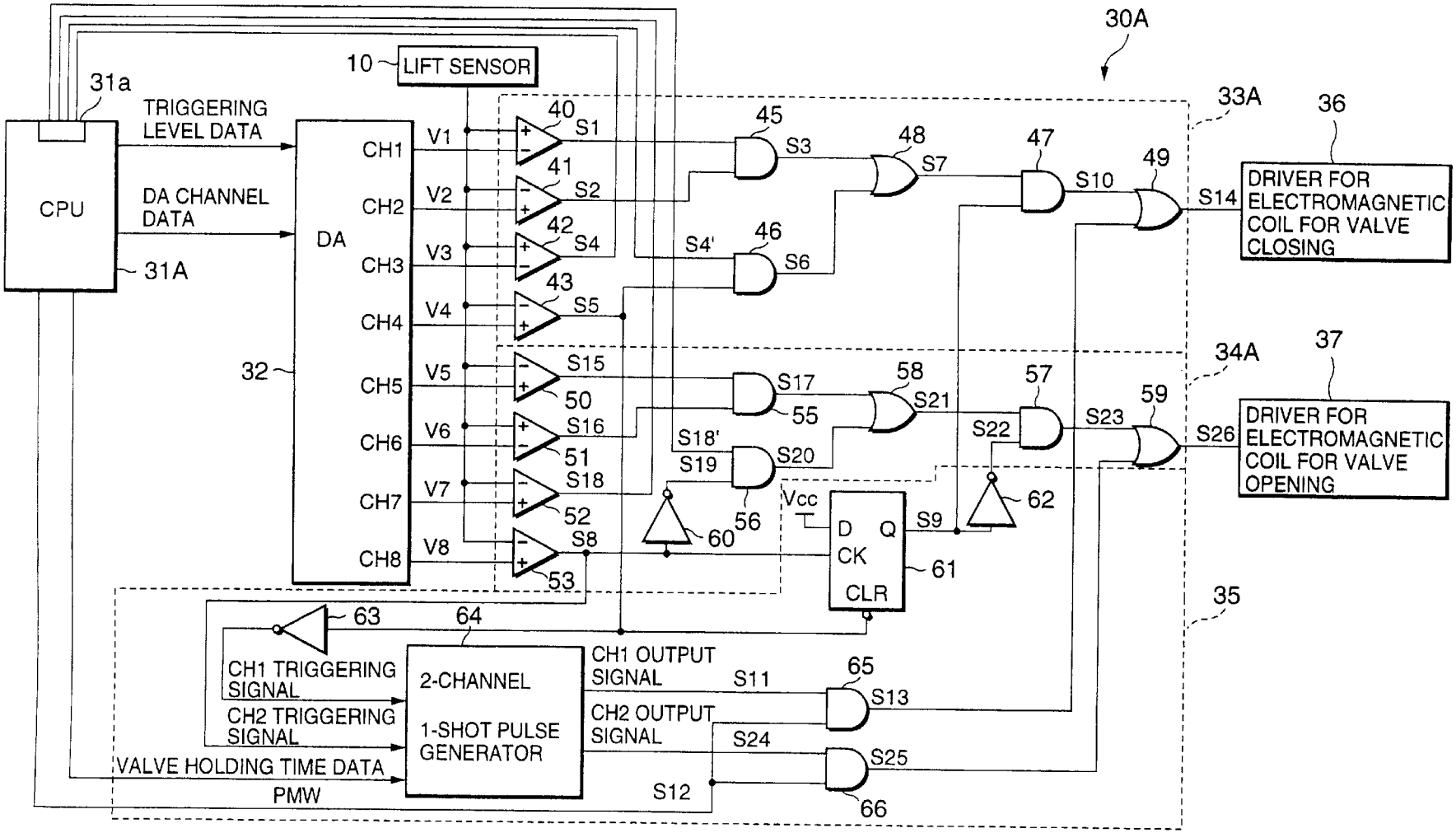
FIG. 8 is a circuit diagram of a speed controller as the second preferred embodiment according to the present invention.

Supplied to the digital timer 31*a* as triggering signals are, as shown in FIG. 8, the output signal S4 of the comparator 42 provided in a controller 33A for the electromagnetic coil 6 for valve closing, and the output signal S18 of the comparator 52 provided in a controller 34A for the electromagnetic coil 5 for valve opening. The digital timer 31*a* then outputs a timer output signal S4' to the AND gate 46 of the controller 33A, and another timer output signal S18' to the AND gate 56 of the controller 34A.

The speed controller 30A works in the same way as the speed controller 30 does as already described. In addition to that, the CPU 31A can vary the time set for the digital timer 31*a*, thus achieving higher timing accuracy.

A speed controller 30B as the third preferred embodiment according to the present invention will be described with reference to FIGS. 9 to 11. Elements in this embodiment that are the same as or analogous to elements in the first embodiment are also referenced by the same reference numerals and will not be explained in detail.

The difference between the first and the third embodiment is triggering timing for timers. In detail, the speed controller 30 shown in FIG. 3 is provided with the comparators 42 and 52 to output signals to the timers 44 and 54, respectively. The speed controller 30B is, on the other hand, not provided with such comparators. Instead, the comparators 40 and 50 output signals S1 and S15 to timers 44*b* and 54*b*, respectively.

The operation of the speed controller 30B will be described only for a driver 33B for the electromagnetic coil 6 for valve closing. The operation for a driver 34B for the electromagnetic coil 5 for valve opening is omitted. Because it is basically the same (except the difference in triggering timing for the timers) as that for the driver 34 shown in FIG. 3 already described.

Figure 9:
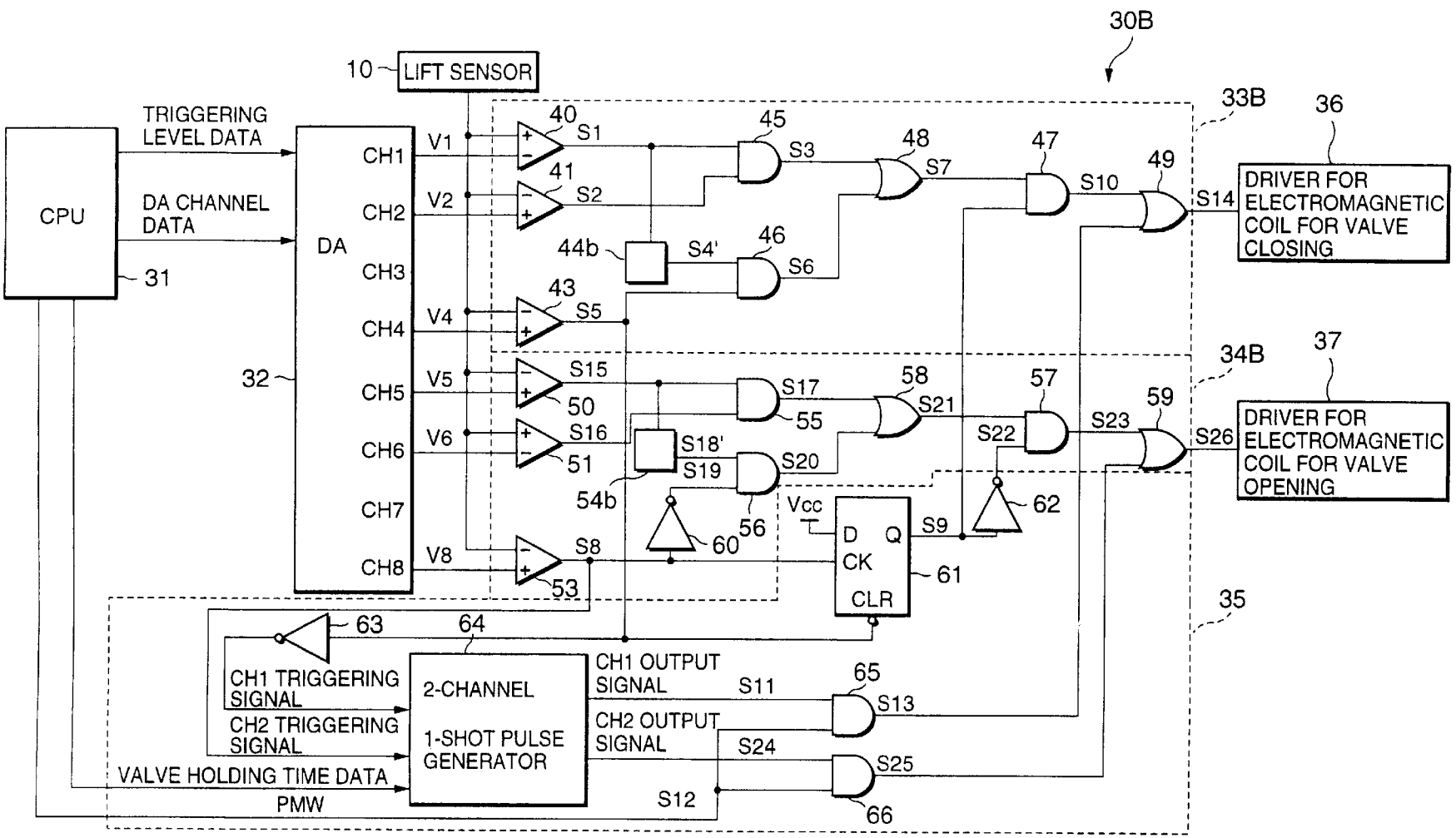
FIG. 9 is a circuit diagram of a speed controller as the third preferred embodiment according to the present invention.
Figure 10:
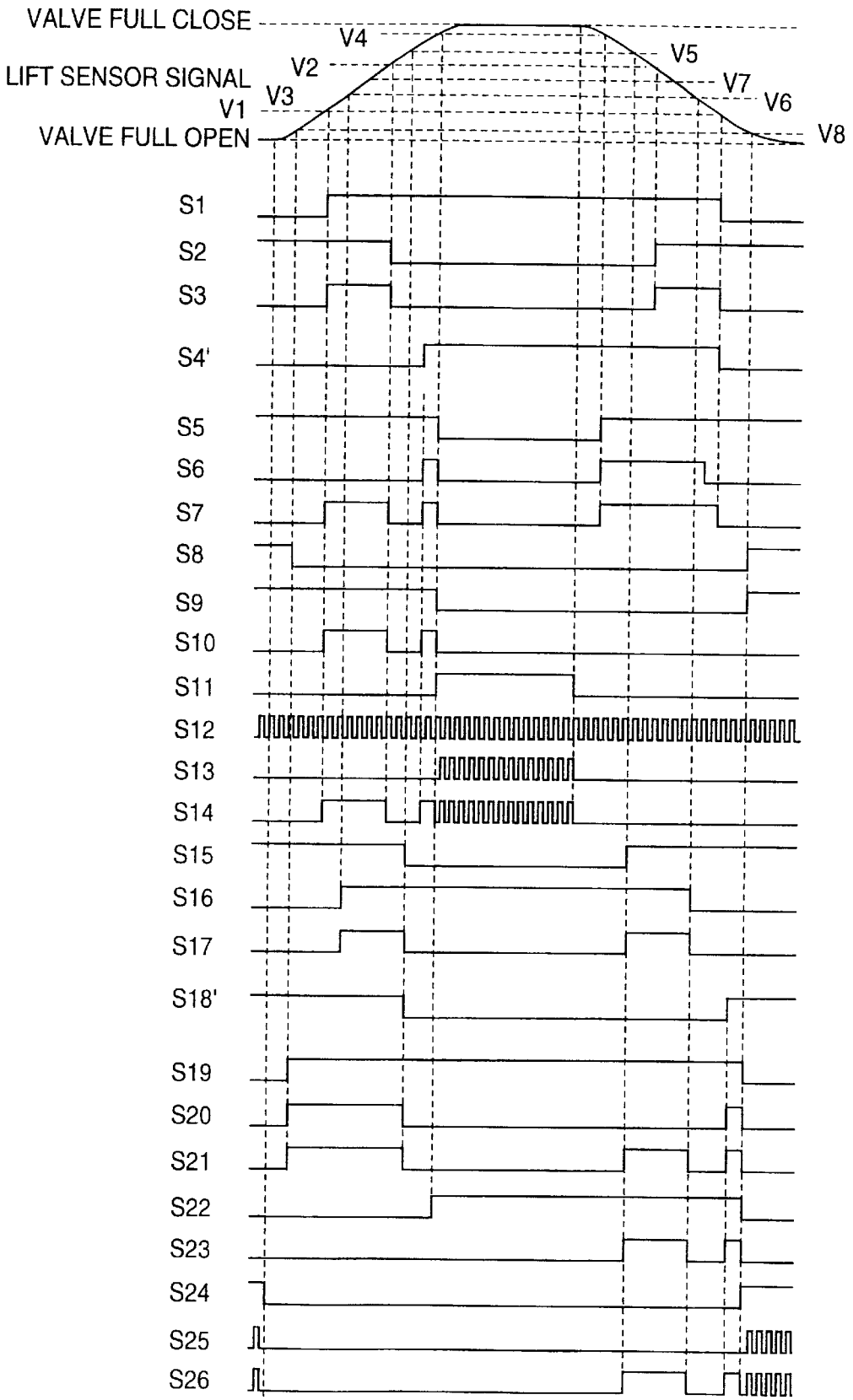
FIG. 10 is a timing chart explaining the timing for various signals shown in FIG. 9.
Figure 11:
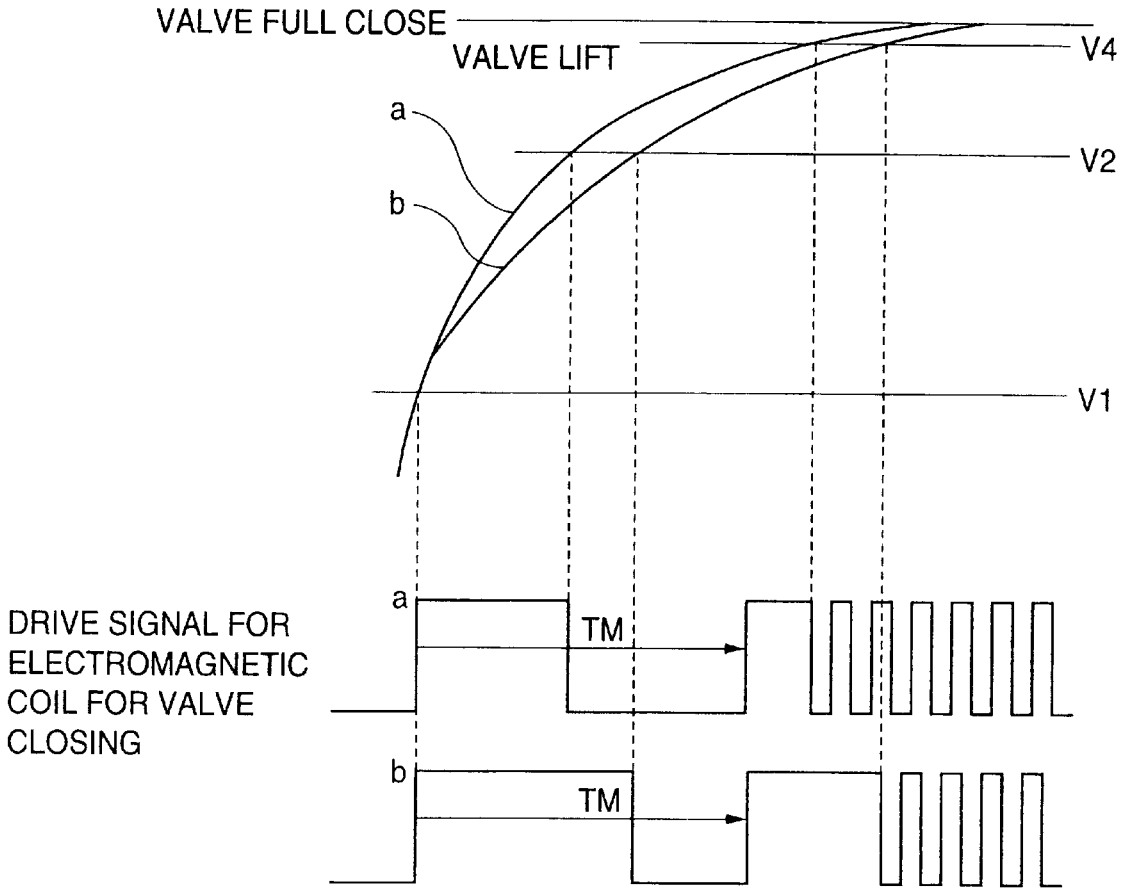
FIG. 11 is a graph explaining the relationship between lift sensor output and valve driving signals for the speed controller shown in FIG. 9.

As shown in FIGS. 9 and 10, when the output of the lift sensor 10 exceeds the triggering level V1 in the initial state of the valve closing operation, the output signal S1 of the comparator 40 turns into a high level from a low level. The electromagnetic coil 6 for valve closing is then firstly energized in the same way as that described for the first embodiment. Simultaneously, the high level signal S1 is supplied to the timer 44*b* which then starts counting.

Next, when the output of the lift sensor 10 exceeds the triggering level V2, the output signal S2 of the comparator 41 turns into a low level from a high level. The electromagnetic coil 6 for valve closing is then de-energized also in the same way as that described for the first embodiment. The coil 6 is energized again when the timer 44*b* stops so that a timer output signal turns into a high level.

As shown in FIG. 10, like the first embodiment, the electromagnetic coil 6 for valve closing is firstly energized at a position to which the valve 4 is lifted and corresponding to the triggering level V1, and is de-energized at another position to which the valve 4 is lifted and corresponding to the triggering level V2.

The timer start timing for the timer 44 of the first embodiment corresponds to the triggering level V3 between V1 and V2. On the other hand, the timer start timing for the timer 44*b* of the third embodiment corresponds to the triggering level V1 at which the electromagnetic coil 6 for valve closing is firstly energized.

The timing for energizing again the coil 6 is almost constant with no relation to a speed of the valve 4 after the coil 6 is energized. Such timing is affected only by a speed at which the valve 4 is moved from a fully opening position in the direction in which the forces of the springs 13 and 19 for valve closing and opening, respectively, are balanced with each other while the electromagnetic coils 5 and 6 for valve opening and closing, respectively, are being de-energized.

When the valve 4 reaches a position just before the valve fully closed position, and then the output of the lift sensor 10 exceeds the triggering level V4, the output signal S5 of the comparator 43 turns into a low level from a high level. The low level signal S5 is inverted by the inverter 63 and then supplied to the one-shot pulse generator 64 as the ch1 triggering signal. The pulse generator 64 generates a high level ch1 output signal which causes the PWM signal from the CPU 31 to be supplied to the driver 36 for the electromagnetic coil 6 for valve closing to control a coil current flowing through the coil 6 as a specific holding current.

The periods of time for de-energizing the electromagnetic coils 5 and 6 for valve opening and closing, respectively, are relatively long for a high valve speed while short for a low valve speed, like the first embodiment.

A stable valve deceleration time thus can be achieved even if a speed of the armature 17 varies to ease a shock of valve sitting caused when the valve 1 is fully closed or which is produced when the armature 17 hits the yoke 7 when the valve 1 is fully opened. Furthermore, the third embodiment does not require any comparator such as the comparators 42 and 52 shown in FIG. 3 for timer triggering, thus achieving simple circuit configuration for cost down. Moreover, the timer 44*b* or 54*b* in this embodiment starts when the electromagnetic coil 6 or 5 for valve opening or closing, respectively, is energized. This timer start operation provides almost constant timing for energizing again the coil 5 or 6 with no relation to the valve speed after the timer 44*b* or 54*b* starts, thus achieving accurate time constant setting for the timers to obtain accurate coil de-energizing timing for higher controllability.

A speed controller 30C as the fourth preferred embodiment according to the present invention will be described with reference to FIG. 12. Elements in this embodiment that are the same as or analogous to elements in the first and second embodiments are also referenced by the same reference numerals and will not be explained in detail.

Figure 12:
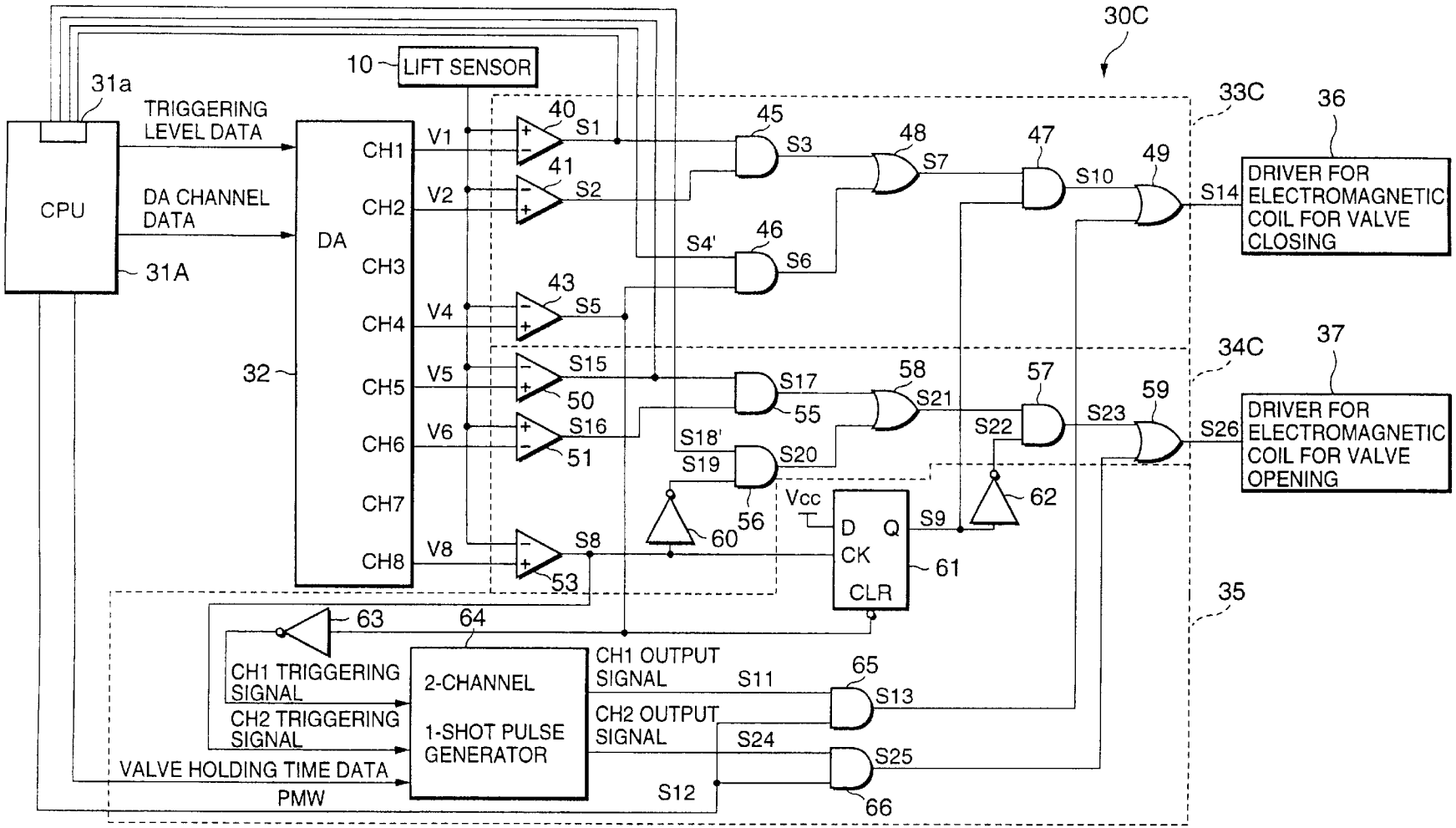
FIG. 12 is a circuit diagram of a speed controller as the fourth preferred embodiment according to the present invention.

A speed controller 30C shown in FIG. 12 is provided with the digital timer 31*a* involved in the CPU 31A using internal clock signals like the second embodiment.

This embodiment is, however, different from the second embodiment, that supplied to the digital timer 31*a* as triggering signals are the output signal S1 of the comparator 40 provided in a controller 33C for the electromagnetic coil 6 for valve closing, and the output signal S15 of the comparator 50 provided in a controller 34C for the electromagnetic coil 5 for valve opening. The digital timer 31*a* then outputs a timer output signal S4' to the AND gate 46 of the controller 33C, and another timer output signal S18' to the AND gate 56 of the controller 34C.

The speed controller 30C works basically the same as the speed controller 30B (the third embodiment) does. In addition to that, the CPU 31A can vary the time set for the digital timer 31*a*, thus achieving higher timing accuracy like the second embodiment.

As described above, after an electromagnetic coil for valve opening or closing is energized, measurement of time starts at a moment before the valve is moved to a position at which the electromagnetic coil is temporarily de-energized for decelerating the valve speed. The temporarily de-energized electromagnetic coil is then energized again after a predetermined period of time has passed from the first moment.

Accordingly, stable deceleration of the valve (or armature) is achieved even if the valve speed varies to ease a shock of valve sitting when the valve is fully closed or which is produced when the armature hits the yoke when the valve is fully opened.

Furthermore, the moment the measurement of time starts corresponds to a position of the valve at which the electromagnetic coil is initially energized. A triggering pulse is thus shared by the electromagnetic coil energizing and the timer starting. This achieves simple circuit configuration for cost down.

Furthermore, the analog timer provides a high speed operation to lighten a burden for the CPU to decide various timing.

Furthermore, the CPU can vary the timing for energizing or de-energizing electromagnetic coils when it involves a digital timer, thus achieving higher timing accuracy.

What is claimed is:

1. An apparatus for controlling an electromagnetic valve having at least an electromagnetic coil and an armature, the electromagnetic coil generating a magnetic filed to cause the armature to move a valve for opening or closing, the apparatus comprising:

a driver to energize the electromagnetic coil to generate the magnetic field;

a timer to start at a moment before the valve is moved to a first position at which the electromagnetic coil is temporarily de-energized and to output a first signal after a predetermined period of time has passed from the moment; and a controller to control the driver to energize the temporarily de-energized electromagnetic coil in response to the first signal.

2. The apparatus according to claim 1, wherein the moment corresponds to a second position of the valve at which the electromagnetic coil is initially energized.

3. The apparatus according to claim 1, wherein the moment corresponds to a second position of the valve between a third position at which the electromagnetic coil is initially energized and the first position.

4. The apparatus according to claim 1, wherein the timer stops before the valve is fully opened or closed.

5. The apparatus according to claim 1, wherein the timer comprises:

an analog integrator to charge a second signal corresponding to time measure by the timer; and a comparator to compare the second signal and a third signal corresponding to the predetermined period of time and to output the first signal when the second signal is equal to or larger than the third signal.

6. A method of controlling an electromagnetic valve having at least an electromagnetic coil and an armature, the electromagnetic coil generating a magnetic filed to cause the armature to move a valve for opening or closing, the method comprising the steps of:

energizing the electromagnetic coil to generate the magnetic field;

starting measurement of time at a moment before the valve is moved to a first position at which the electromagnetic coil is temporarily de-energized and to output a signal after a predetermined period of time has passed from the moment; and energizing the temporarily de-energized electromagnetic coil in response to the signal.

7. The method according to claim 6, wherein the moment corresponds to a second position of the valve at which the electromagnetic coil is initially energized.

8. The method according to claim 6, wherein the moment corresponds to a second position of the valve between a third position at which the electromagnetic coil is initially energized and the first position.

9. The method according to claim 6 further comprising the step of terminating the measurement of time before the valve is fully opened or closed.

10. A method of controlling an electromagnetic valve having at least a first and a second electromagnetic coil and an armature, the first electromagnetic coil generating a first magnetic filed to cause the armature to move a valve for closing, and the second electromagnetic coil generating a second magnetic filed to cause the armature to move the valve for opening, the method comprising the steps of:

energizing the first electromagnetic coil to generate the first magnetic field;

starting first measurement of time at a first moment before the valve is moved to a first position at which the first electromagnetic coil is temporarily de-energized and to output a first signal after a predetermined period of time has passed from the first moment;

energizing the temporarily de-energized first electromagnetic coil in response to the first signal;

de-energizing the first electromagnetic coil when the valve is fully closed;

energizing the second electromagnetic coil to generate the second magnetic field after the first electromagnetic coil is de-energized;

starting second measurement of time at a second moment before the valve is moved to a second position at which the second electromagnetic coil is temporarily de-energized and to output a second signal after a predetermined period of time has passed from the second moment; and energizing the temporarily de-energized second electromagnetic coil in response to the second signal.

11. The method according to claim 10 further comprising the step of terminating the first measurement of time before the valve is fully closed.

12. The method according to claim 10 further comprising the step of terminating the second measurement of time before the valve is fully opened.

13. The method according to claim 10 further comprising the steps of:

de-energizing the second electromagnetic coil when the valve is fully opened; and energizing the first electromagnetic coil after the second magnetic coil is de-energized.

* * * * *